United States Patent [19]

Seragnoli

[11] 4,020,608

[45] May 3, 1977

[54] WRAPPING AND SEALING MACHINE

[75] Inventor: Enzo Seragnoli, Bologna, Italy

[73] Assignee: G. D. Societa per Azioni, Italy

[22] Filed: Mar. 20, 1975

[21] Appl. No.: 560,139

[30] Foreign Application Priority Data

Apr. 17, 1974 Italy ..... 3361/74

[52] U.S. Cl. ..... 53/234; 53/375; 53/388

[51] Int. Cl.[2] ..... B65B 11/32

[58] Field of Search ..... 53/234, 375, 379, 388, 53/77; 93/12 C; 198/482, 608

[56] References Cited

UNITED STATES PATENTS

| | | | |
|---|---|---|---|
| 1,626,378 | 4/1927 | Armstrong | 53/379 X |
| 2,234,175 | 3/1941 | Jackson | 53/379 X |
| 2,660,219 | 11/1953 | Haas et al. | 53/77 X |
| 2,726,499 | 12/1955 | Fischer et al. | 53/379 |
| 2,855,977 | 10/1958 | Wagner | 53/388 |
| 2,949,001 | 8/1960 | Zwarycz | 53/379 X |
| 3,405,505 | 10/1968 | Mistarz | 53/375 X |
| 3,628,309 | 12/1971 | Seragnoli | 53/234 X |
| 3,670,475 | 6/1972 | Seragnoli | 53/234 |
| 3,802,325 | 4/1974 | Bardenhagen | 93/12 C X |

*Primary Examiner*—Travis S. McGehee
*Assistant Examiner*—John Sipos
*Attorney, Agent, or Firm*—Robert E. Burns; Emmanuel J. Lobato; Bruce L. Adams

[57] ABSTRACT

A device for sealing wrapping material on pieces of candy or similar products, in what is known as the "soap" style of wrapping, and for exiting the products, in their sealed wraps, from the wrapping machine. Each wrapped product is first received in a correspondingly dimensioned pocket of a horizontal conveyor disk, which intermittently conveys the product along a sequence of plates, comprising a presser plate, a first heat-welding plate, and a first cooling plate. The presser plate eliminates bulges of the sides of the product, created during the wrapping. It presses other sides of the product, with folded tabs of the wrap thereon, into the pocket. The heat-welding plate then seals portions of the wrap on a then exposed side of the product. After the cooling and during one of the steps in the intermittent travel of the disk, the product enters a similarly dimensioned but differently arranged pocket of a vertical, intermittently movable conveyor disk, which by the next following steps in its intermittent travel conveys the product along a second set of heat welding and consecutive cooling plates, for sealing the folded tabs of the wrap on then exposed sides of the product. The vertical disk finally brings the product in its sealed wrap to an exiting station.

4 Claims, 3 Drawing Figures

WRAPPING AND SEALING MACHINE

BACKGROUND OF THE INVENTION

This invention relates to machines which form individual pieces of candy or other similar products out of a continuous candy rope and then wrap them in what is known as the soap style. The new machine has a device for performing, on the wrapped products, final transfer, sealing, cooling and ejection operations.

DESCRIPTION OF THE PRIOR ART

With reference to the known art and, in particular, to te very high output speed machine according to U.S. Pat. No. 3,670,475 of the assignees hereof a continuous candy rope is fed to the intake point on such a machine, where it is first roughed and shaped, then divided up into individual parallelepiped products.

The products, fed one at a time between two horizontal guides by a pusher member, intercept cuttings of wrapping material.

During a subsequent transfer carried out by a wheel or rotatable head moved intermittently and provided with a plurality of pairs of gripper devices for holding on to the products and the respective cuttings of wrapping material, fixed and movable folding fingers attend to the carrying out of the various wrapping operations.

A pusher member, given a reciprocating movement and radial with respect to the wheel, has the task of expelling the wrapped products and of inserting them between two horizontal fixed guides.

A second pusher member, given a reciprocating movement perpendicularly with respect to the former, transfers the products into pockets in a continuously moving chain or belt, which constitutes the exiting channel of the machine.

While the transfer on to the chain or belt is taking place, one or more electrically heated plates attend to heat sealing to wrap on the products, after which a cooling sleeve cools them.

The number of welding plates destined to operate on one or more sides of the wrap depends on the type of wrap to be realized, since one of the particularly advantageous characteristics of this type of machine is that it is able, when slight modifications are made, to wrap in various wrapping styles.

With particular reference to what is known as the soap style of wrap, that is to say, to the style in which the wraps on the machine according to the present invention are sealed or welded, it is necessary for welding operations to be carried out, first on the side on which the longitudinal ends of the cutting of wrapping material are superposed, and second on the two opposite sides of the product where the two tabs, characteristic of this type of wrap, are folded with one partly superposed over the other.

Heretofore, in order to facilitate the insertion of the products into the exiting channel which, as previously stated, moves continuously, the pockets have had to necessarily be oversized considerably with respect to their extension in the movement direction, in such as way as to exclude any possibility of their getting knocked as they go in.

Bearing in mind the plastic nature of the products under consideration, the failure of the walls of the pocket to fit closely around the products results in their original parallelepiped shape being notably deformed.

This deformation is aggravated by the pressing action of the welding plates and of the cooling means.

This problem, moreover, is already created in part at the time the wrapping operations are being carried out on the rotatable head. The sides of each product not flush up against the surface of the grippers tend to swell and to bulge.

SUMMARY OF THE INVENTION

The object of the present invention is, therefore, to overcome all the aforementioned difficulties through the realization of a machine of the type previously described, which is able to deliver up wrapped products of a perfect parallelepiped shape and, more particularly, a machine in which every cause for deformation of the product has been eliminated and which, furthermore, is able to correct any deformation which may have occurred earlier on during the wrapping stages.

A further object of the present invention is, in conformity with the preceding object, to realize a machine of the above mentioned type, which is able to attain higher operating speeds than the machines of a known type.

In accordance with the invention the objects are achieved with the aid of a first conveyor disk moved with an intermittent rotary motion and provided with pockets around its periphery, designed to house parallelepiped shaped articles of the exact dimensions of the products to be produced. Spaced apart, along this disk, there are a presser device provided with a vertical reciprocating movement, for flattening, and giving emphasis to certain parts of the wrap, while equalizing the thickness of the products; heat-welding and cooling plates and a second conveyor disk disposed at right angles to the first and for directly receiving a succession of individual products from the first conveyor, the second conveyor also being moved with an intermittent motion and provided with product-fitting pockets around its periphery, and having plates on its sides for heat-welding and ultimately cooling the folds of the wrap.

DESCRIPTION OF THE PREFERRED EMBODIMENT

Figure 1:
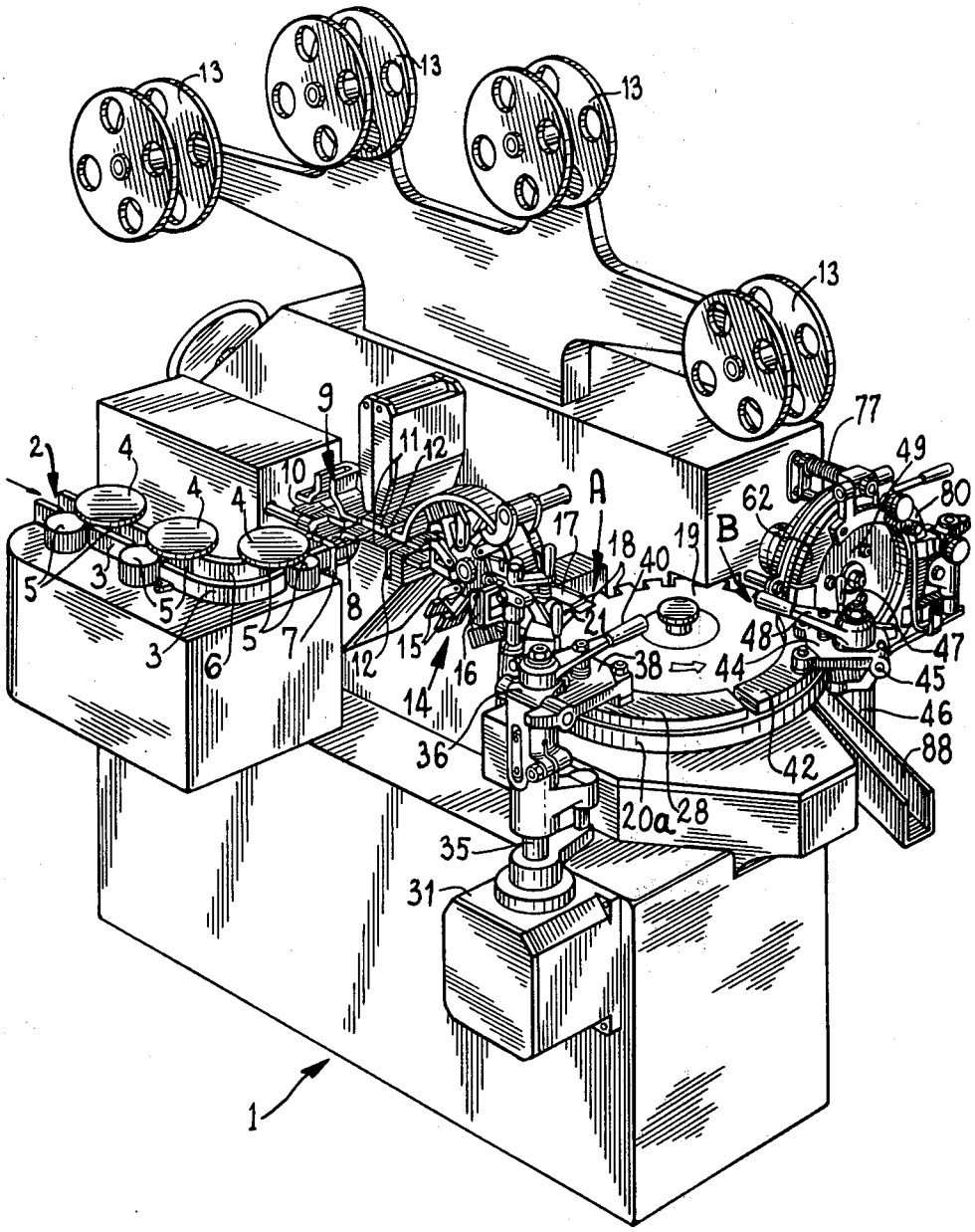
FIG. 1 shows schematically, in a front perspective view, the new machine.

With reference to FIG. 1, at 1, shown in its entirety, there is a machine for forming and wrapping, in the style known as the soap style, candies or other similar products, out of a continuous candy rope, in accordance with the description given in U.S. Pat. No. 3,670,475 the assignees hereof. The illustrated machine also comprises the improved wrap-sealing and product exiting device according to the present invention.

In comformity with the description given in the above mentioned patent, the insertion and forward movement of the continuous candy rope takes place through a channel 2, delimitated by two vertical walls 3, inside which it is progressively roughed and shaped, laterally and at the base by the said walls and by the bottom of the channel, respectively, and on the top by a succession of disks 4.

The forward motion of the continuous candy rope inside the channel 2, entrusted to a number of pairs of rollers 5, proceeds uninterruptedly up as far as a curvature 6. Thereafter and from a final pair of rollers onwards it becomes intermittent.

At the far end of channel 2, a cutting device 7 divides the rop up into individual parallelepiped products, which, as mentioned above, are still of a plastic nature, so that they can be plastically deformed, either intentionally or unintentionally. Each of these products is inserted into a pocket 8 belonging to a wheel 9 with pockets in it, rotatable around a horizontal shaft intermittently in a counter clockwise direction. For insertion of a product, a pocket 8 is at a standstill in a first position. After rotating through 90°, the pocket 8 halts in a second position where a pusher member 10 provided with a horizontal reciprocating motion drives the product into a space between two horizontal, parallel guides 11.

Running transversely across the guides 11 there is a vertical slit 12 through which a succession of cuttings of wrapping material supplied by reels mounted on real carriers 13 is intermittently supplied.

As each product moves along, its front side in the movement direction engages with and drags along a cutting of wrapping material, on which two guides 11 perform an initial U folding operation, causing the cutting to become attached to the top and bottom sides of the product.

The wrapping operations continue through fixed and movable folding fingers shown in FIG. 1. As already mentioned hereinabove, these fingers are located along the periphery of an intermittently rotatable wheel 14, which grasps the products and their wrapping materials. The fingers include at least one that oscillates in the inside of the wheel which is horizontal shaft mounted and parallel with the aforementioned wheel 9. The wheel 14 rotates intermittently in a counter clockwise direction and is provided with a plurality of pairs of radial grippers 15. As mentioned above, the gripper action may cause swelling of side portions of the products.

Figure 2:
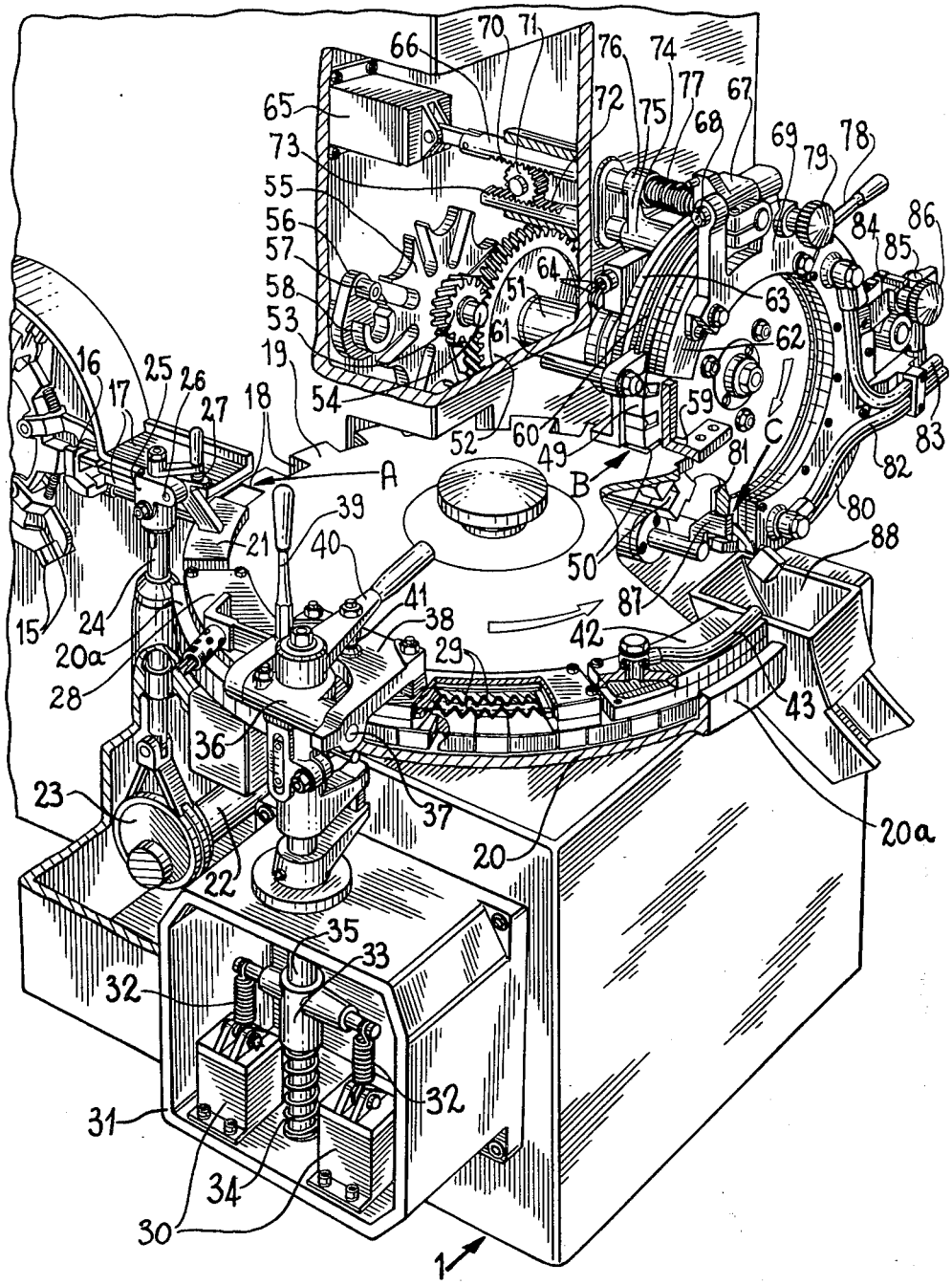
FIG. 2 shows on a larger scale and again as a perspective view, the new sealing and conveying device of the machine with some parts broken off.

Expulsion of the partially wrapped products takes place in a station diametrically opposed to that where the intake occurs, the expulsion being carried out by an extractor 16 best shown in FIG. 2 and which, sliding radially with respect to the wheel 14, inserts the individual products between two horizontal, parallel guides 17. By action of these, the soap style wrap is completed.

The products have thus been wrapped in accordance with the description given in the above-mentioned patent.

Past the final extremity of the guides 17, the products are inserted by the aforementioned extractor 16 into a pocket 18.

The pocket 18, waiting at a point corresponding to where an entry station A of the new sealing unit is located, belongs to a conveyor disk or plate 19 mounted on a vertical shaft, around which it is intermittently rotatable in a counter clockwise direction. There is a plurality of pockets 18, open on the edge and on the upper and lower sides of the plate 19. The pockets are of the exact size to suit the parallelepiped products to be wrapped and sealed.

A fixed horizontal plate 20, provided with a vertical flange **20*a* coaxial with the plate 19** and which also has a transfer station B, serves as a supporting and retaining member for the products.

Figure 3:
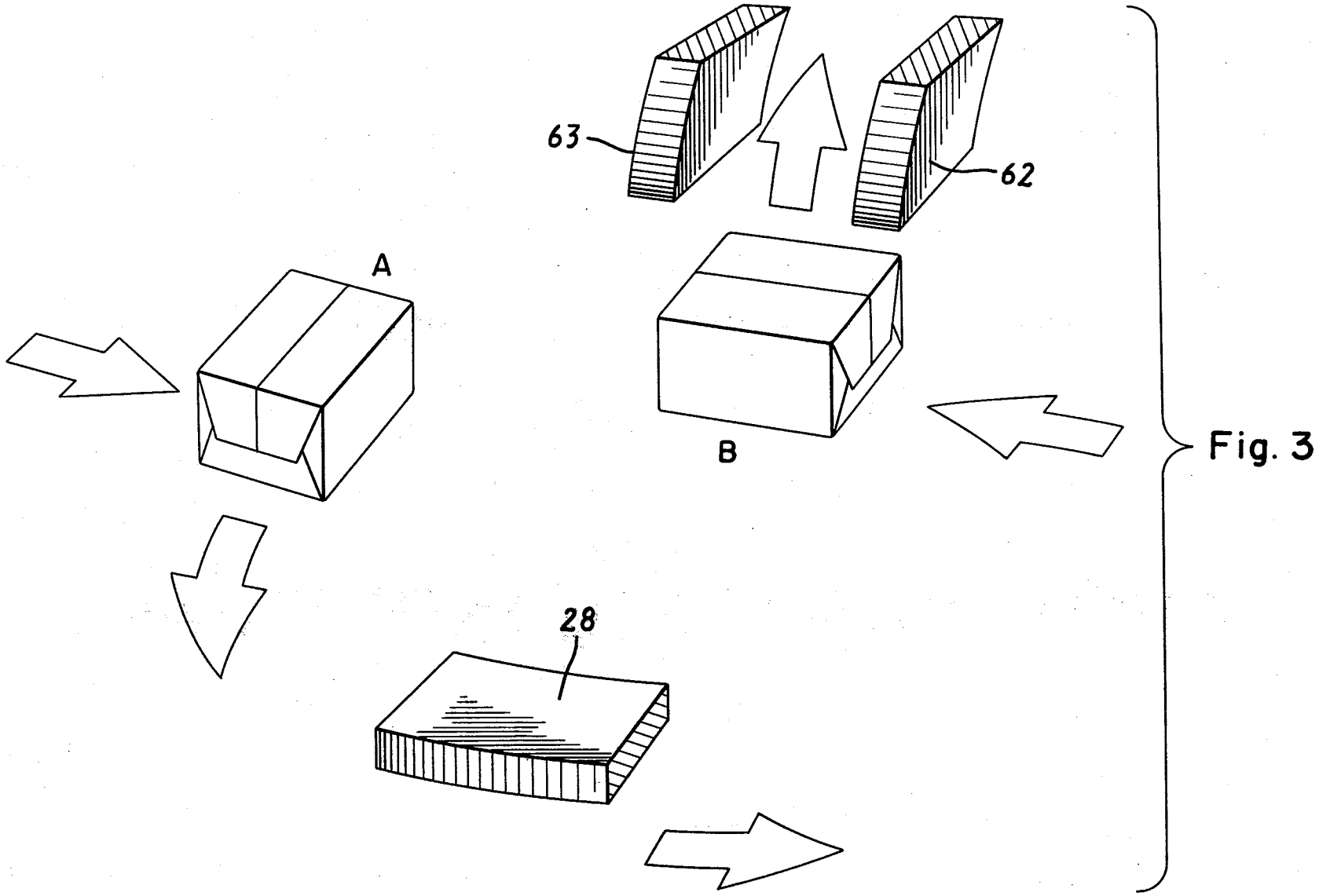
FIG. 3 shows, on a still larger scale, wrapped products in process for being sealed and conveyed by the new device.

Each of these is inserted, lying flat, into one of the pockets 18, in such a way as to have as its top side, a side on which two longitudinal end portions of the cutting of wrapping material are mutually superposed (FIG. 3, at left) and, furthermore, so that the two other mutually opposite sides on which tabs, characteristic of the soap style of wrap, are folded, be flush up against the approximately radial side walls of the respective pocket 18, as may be noted in the drawing (front of FIG. 2 and rear of FIG. 3).

In a station defined by a part of the circumference of the fixed plate 20 immediately after the entry station A, the wrapped products are subjected at the top to the action of a pressure member 21.

The presser member 21, provided with a vertical reciprocating motion, has the task of flattening any bulges on the sides, and emphasizing or sharpening the folds of the folded tabs on the previously made wrap, as well as bringing the thickness of the plastic parallelepiped products to its proper measure, thereby correcting said bulges and preparing the products for the further processing stages through which they have to pass.

The presser member 21, which operates every time the plate 19 comes to a halt, takes its drive from a horizontal shaft 22, carried by the frame of the machine 1.

Through an eccentric device 23 and a vertical shaft 24, the horizontal shaft 22 passes a reciprocating motion on to a block 25 provided with a horizontal pin 26 to which the presser member 21 is hinged.

Under normal operating conditions, the presser member 21 is locked on to its support means 25, 26 in the position shown in FIG. 2, but in cases of emergency or for maintenance operations, it can be unlocked and caused to rotate upwards around the pin 26 by removal of a stay 27 provided with a grip pivoted to block 25.

Upon completion of the wrap-flattening and thickness-correcting operation, in a subsequent series of stations, the upper sides of the wraps on which, as previously stated, the two ends of the cutting of wrapping material are superposed, are subjected to a welding operation by a plate 28 heated by a resistance 29.

The plate 28, shaped in the form of a circulr segment, extends arcuately over a suitable number of stations, defined by pockets 18, to guarantee the operation being perfectly successful.

Under normal operating conditions, the plate 28 slidingly contacts the plate 19, but for the event that the intermittent movement of the latter stops and so as to prevent the products from too prolonged a contact with the heated surface, a device is provided for automatically raising the plate 28.

This device comprises two electromagnets 30 housed in a compartment 31 integral with the frame of the machine 1. Through the springs 32, these operate two opposite, horizontal arms with which a vertical sleeve 33 is provided.

Sleeve 33 is upwardly biased, at its bottom, by a spring 34, and is locked on to a vertical shaft 35 which can slide axially through the compartment 31.

Outside the compartment 31, the upper extremity of the shaft 35 is integral with a block 36 connected, by means of a pivot 37, to a support 38 of the plate 28.

In the event of a stoppage of the machine and thus consequentially of the conveyor plate 19, the two electromagnets 30 are automatically de-energized, the machine being driven by electric power, as is usual and is also shown in the above-mentioned patent. As a result, due to the action of the spring 34, the shaft 35 moves axially upward and removes the plate 28 from the upper surface of the plate 19.

While under normal operating conditions the plate 28 is locked in the position shown in FIG. 2, in cases of emergency or for maintenance operations, it can be rotated around the pivot 37 by manually moving a vertical lever 39 integral with the support 38, after first having freed a horizontal rod 40 hinged on the block 36 and provided with a stay 41 operating on the support 38.

Once the operation of welding the top side of the wraps has been brought to an end in the way described, the wrapped products are immediately subjected to a cooling operation.

This is entrusted to a plate 42, also shaped in the form of a circular segment, extending above the plate 19 between the final extremity of the welding plate 28 and the wrapped product transfer station B.

The plate 42, wherein cooling water is injected through a pipe 43 and cleared through a pipe not visible in FIGS. 1 and 2, is carried by a support 44 connected through a pivot 45 horizontally to a block 46 integral with the frame of the machine 1.

In an identical way to that seen for the plate 28, the plate 42 can also be raised in the case of need by rotating it around the pivot 45, manually using a vertical lever 47, after a horizontal rod 48, provided with a grip and having the same purpose as the rod 40, has been freed.

Upon completion of the welding and cooling operations on the part of the above described devices, the products wrapped in what is known as the soap style are subjected to a further sequence of welding, cooling and exiting operations.

At a point corresponding to where the transfer station B is located, which is past the final end of the cooling plate 42 on the support plate 20, the products, now wrapped in top welded wraps are supplied to a second, horizontal shaft mounted conveyor or disk or plate 49 which rotates intermittently in a clockwise direction and, along its periphery, is provided with a plurality of radial pockets 50, designed to accept the products from disk 19 by motions of that disk normal to the plane on which the disk 49 itself lies.

The distance between the shafts of the two plates 19 and 49 and the design of their compartments 18 and 50 are such that in the transfer station B, the wrapped and top-sealed product contained in one pocket 18 of the plate 19 is inserted directly, without the aid of transfer means, into a pocket 50 in the plate 49, while the latter-plate is at a standstill. The product is thereafter transferred, once the plate 49 resumes its intermittent movement, towards further processing stages, and on further stops of plate 49, plate 19 can enter further pockets 50.

Arranged in this new way, the two sides of each piece of candy, on each of which sides the two tabs characteristic of the soap style of wrap are folded, lie on the two sides of the plate 49.

The plate 49 is mounted on a horizontal shaft 51 supported by the frame of the machine 1. The shaft is rigid at its other end with a gear 52, which derives its rotation from a second gear 53.

The second gear 53 is rigid with a shaft 54 on to which is keyed an eight compartment Geneva mechanism 55 operated by a device 56 of a known type provided with a pin or idle roller 57 and an acurate sector or centering device 58.

In this way, each time the device 56 completes one full rotation, the plate 49 moves forward one step around its shaft.

Over an initial arc, starting from transfer station B, the peripheric area of the plate 49 and the corresponding pockets 50 arc delimitated by a fixed retaining guide 59.

Past the final extremity of the guide 59, there in a casing 60 secured by a shaft 61 to the frame of the machine 1 and this extends along the outside edge of the plate 49 to an exiting station C, its purpose being to prevent the wrapped products from spilling while being intermittently rotated.

From the end of guide 59 where the casing 60 commences, two circular segment welding plates 62 and 63 are provided along the two opposite sides of the plate 49 and these extend sufficiently far to delimitate the right number of stations necessary to guarantee the perfect success of the further welding operation.

The said plates 62 and 63 are heated by electrical resistances, only the terminals 64 of which are visible in FIG. 2 and their purpose is to weld the tabs folded on the mutually opposite sides of the product, one of which is as shown in FIG. 2 and on a larger scale in FIG. 3.

Under normmal operating conditions, the two welding plates 62 and 63 are in contact with the conveyor plate 49 but to provide for the event of the latter coming to a prolonged halt, a device is provided with which to contemporaneously remove the said two plates 62 and 63 from the surface of the plate 49, exactly as previously seen for the plate 19, in order to prevent there being too prolonged a contact of the wrapped products with the heated surfaces.

This device comprises an electromagnet 65 housed inside the frame of the machine 1 and this, through a rod 66, exerts a pulling action on a block 67 connected via a pivot 68 to a support 69 of the front plate 62.

The lower part of rod 66 is provided with toothing 70 which mates with a gear 71 idling on a horizontal shaft. The gear in turn meshes with toothing 72 on a second rod 73 parallel with rod 66.

On the outside of the frame, the other end of rod 73 is fastened to a block 74 integral with the rear plate 63 whose characteristics are the same as those of the front plate 62.

The block 74 is provided with an arm 75 equipped with a sleeve 76 which slides on the rod 66, on which is also threaded, in the section between the sleeve 76 and the block 67, a spring 77.

While the machine is in operation, the spring 77 is compressed and the two plates 62 and 63 are urged to the plate 49.

In the event of a stoppage on the part of the machine and thus consequently of the plate 49, the electromagnet 65 is automatically de-energized and the two plates 62 and 63, on account of the pressing action of the spring 77, are moved away from the front side and the rear side, respectively, of the plate 49.

In an emergency or for maintenance operations, the plate 62 which is normally locked in the position shown in FIG. 2, can be rotated around the pivot 68 by manually moving a lever 78 once a stay 79 fitted with a knob and hinged to the block 67 in a way not visible in FIG. 2 has been freed.

Upon completion of the final stage of the wrap welding operation executed in the way described, the wrapped products are subjected to a second cooling operation.

This is carried out by two plates 80 and 81 shaped in the form of circular segments, which extend on the two opposite sides of the plate 49 between the far extremities of the welding plates 62, 63 and the exiting station C.

Water is made to circulate in the inside of the cooling plates and this, insofar as the front plate 80 is concerned, is injected through a pipe 82 and cleared through a pipe 83.

While the rear plate 81 is directly connected to the frame of the machine 1, the front plate 80 is integral with a support 84 connected through a vertical pivot 85 with supporting means not shown in FIG. 2.

Similarly to what has been seen previously, in case of need the plate 80 too can be moved away by rotating it around the pivot 85 after a stay 86, provided with a knob and hinged to the support 84, has been freed.

Beyond the final extremity of the two cooling plates 80 and 81, following the described operations of welding and cooling the folded tabs, the wrapped products in the station C are sent forward to a collating device by an ejector member 87, provided with a horizontal reciprocating movement, which engages with the rear side of the pieces of candy causing them to drop into a chute 88.

What is claimed is:

1. A wrapping and sealing maching, comprising:

a. an intermittently movable wrapping assembly for wrapping plastic products, each having a parallelpiped shape, in wraps each defined by sheet like material wrapped about four consecutive sides of the respective product, the wrap having end portions thereof mutually superposed on one of the sides and having tabs folded on the two other, mutually opposite sides on the product;

b. a first sealing and conveying unit, comprising: a disk movable in intermittent rotary steps synchronically with the wrapping assembly and having circumferential pockets, each disposed to be brought into a product-receiving station by one of the rotary steps to receive one of the products with the mutualy superposed wrap portions exposed on a side of the disk, the disk having, in each pocket, two end walls approximately radial of the disk, spaced apart a distance equal to that between the folded tabs and normally in contact with the folded tabs on the product received in the pocket, each pocket having open sides on parallel sides of the disk, a supporting plate parallel with the disk and extending along a circumferential portion thereof to close one of said open sides, the unit also having, in overlying relationship with consecutive circumferential segments of the disk: a presser plate disposed opposite the supporting plate and reciprocably movable toward the disk to press the received plastic products into the respective pockets and thereby to flatten the mutually superposed wrap portions and the folded tabs, a heat-welding plate for weld-sealing the mutually superposed wrap portions, and a cooling plate for cooling the heat-welded, weld-sealed wrap portions; and c. a second sealing and conveying unit, comprising; a generally similar disk having heat-welding and cooling plates disposed respectively to heat-weld the folded tabs and to cool the heat-welded tabs, the second unit also having means for discharging the wrapped products with heat-welded wrap portions and tabs thereon, the disk of the second unit being normal to the disk of the first unit and the two disks being disposed to intersect one another at a location remote from the supporting, heat welding and cooling plates by having one of the pockets of one of the disks coincide with one of the pockets of the other disk upon each intermittent rotary step for directly transferring a wrapped product with the heat-welded and cooled wrap portions thereof to the second unit for the heat-welding and cooling of the folded tabs.

2. A machine according to claim 1 in which the disk and supporting plate of the first unit are disposed in a horizontal plane, and the disk of the second unit is disposed in a vertical plane and has a second heat-welding plate and a second cooling plate, the respective plates of the second unit being disposed opposite one another, on opposite sides of the disk thereof.

3. A machine according to claim 2 including a cylindrical arcuate casing extending from said location and circumferentially of the disk of the second unit to retain the wrapped products in the pockets of said disk.

4. A wrapping and sealing machine, comprising;

a. an intermittently movable wrapping assembly for wrapping plastic products, each having a parallelepiped shape, in wraps each defined by sheet-like material wrapped about four consecutive sides of te respective product, the wrap having end portions thereof mutually superposed on one of the sides and having tabs folded on the two other, mutually opposite sides on the product;

b. a first sealing and conveying unit, comprising: a disk movable in intermittent rotary steps synchronically with the wrapping assembly and having circumferential pockets, each disposed to be brought into a product-receiving station by one of the rotary steps to receive one of the products with the mutually superposed wrap portions exposed on a side of the disk, the disk having, in each pocket, two end walls approximately radial of the disk and interconnected circumferentially of the disk and each pocket having open sides, on parallel sides of the disk, the unit also having, in overlying relationship with consecutive, circumferential segments of the disk, a heat-welding plate for weld-sealing the mutually superposed wrap portions, and a cooling plate for cooling the heat-welded, weld-sealed wrap portions; and c. a second sealing and conveying unit, comprising, a generally similar disk having heat-welding and cooling plates disposed respectively to heat-weld the folded tabs and to cool the heat-welded tabs, the second unit also having means for discharging the wrapped products with heat-welded portions and tabs thereon, the disk of the second unit being normal to the disk of the first unit and the two disks being disposed to intersect one another at a location remote from the heat-welding and cooling plate by having one of the pockets of one of the disks coincide with one of the pockets of the other disk upon each intermittent rotary step for directly transferring a wrapped product with the heat-welded and cooled wrap portions thereof to the second unit for the heat-welding and cooling of the folded tabs.

* * * * *